US005083351A

United States Patent [19]

Gabathuler et al.

[11] Patent Number: 5,083,351

[45] Date of Patent: Jan. 28, 1992

[54] BAND CUTTING MACHINE

[75] Inventors: Ferdinand Gabathuler, Grabs; Nikola Krmpotic, Hinwil; Erik G. Nilsson, Werdenberg, all of Switzerland

[73] Assignee: Maschinen AG Swegea, Buchs, Switzerland

[21] Appl. No.: 355,476

[22] Filed: May 22, 1989

[30] Foreign Application Priority Data

May 27, 1988 [CH] Switzerland ..... 02021/88

[51] Int. Cl.[5] ..... B26D 1/24

[52] U.S. Cl. ..... 29/2.19; 29/2.21; 83/72; 83/175; 83/500; 83/935

[58] Field of Search ..... 29/2.1, 2.15, 2.18, 29/2.19, 2.2, 2.21, 2.22; 83/175, 429, 433, 500, 72, 935

[56] References Cited

U.S. PATENT DOCUMENTS 4,131,979 1/1979 King et al. ..... 29/2.19

4,592,260 6/1986 Gabathuler et al. ..... 83/74

*Primary Examiner*—Hien H. Phan

*Attorney, Agent, or Firm*—Ladas & Parry

[57] ABSTRACT

By means of a bracket located above the turntable the twisting of the textile article threaded through this bracket can be scanned and measured by a feeler means. Upon the twisting the bracket will rotate by a certain angle. If a preset angle of rotation is exceeded, the feeler sends a control signal to the control apparatus. This control apparatus controls the relationship circumferential speed feeding cylinders to rotational speed turntable. By means of such controlling an extremely fine regulating can be made, which may be necessary, for instance, due to the slip between the tubular textile article and the feeding cylinders. The upper edge of the textile article being cut is scanned by means of at least one scanner. The location of the scanning is preferably between the final feeding cylinder (seen in direction of movement of the textile article) and the cutting tools of the cutting apparatus. The emitted signals of this scanner are led to an adjusting device which controls the stroke of the oscillating jacket members of the feeding cylinders. By means of this controlling arrangement, namely on the one hand the controlling of mentioned relationship and on the other hand of the strokes of the jacket members of the transporting cylinders, bands having set widths can be cut with a large precision.

1 Claim, 3 Drawing Sheets

BAND CUTTING MACHINE

BACKGROUND OF THE INVENTION

1. Field of the Invention

The present invention relates to a band cutting machine including a motor driven turntable intended to support a supply of a tubular textile article to be cut, a first feeler means operative to scan the rotational position relative to the turntable of a section of the textile article which has been drawn off the supply resting on said turntable, but which is not yet spread out for the cutting operation, a plurality of motor driven rotating article feeding cylinders which have each a plurality of axially oscillating jacket members having an adjustable stroke, at least one second feeler means operative to respectively scan the position of a section of the edge of the tubular textile article in the condition spread out by said article feeding cylinders, and a cutting means having rotating cutting members for cutting said textile article into at least one band.

2. Description of the Prior Art

A band cutting machine of the kind set forth above is disclosed in the U.S. Pat. No. 4,592,260. This known band cutting machine operates dependably and satisfactorily. There is, however, the desire to produce textile bands having a still more precise uniformity and smoothness of the cut edges. It is generally known, that textile articles are generally limp structures, i.e. it is possible to exert tensional forces on the textile article, however it is impossible to exert a pressure thereupon, specifically on bands. Textile articles incorporate a further drawback, that they deform when subject to a high tension or pulling, respectively, loading. Because now also the contact forces between textile articles and rotating machine members which transport such articles, e.g. rollers, must be kept as small as possible due to above mentioned reasons, it is a common occurrence that at least from time to time a slipping between such transporting rollers or cylinders, respectively, and the textile article is suffered.

SUMMARY OF THE INVENTION

It is, therefore, a general object of the invention to provide a band cutting machine, in which above mentioned characteristics of a given textile material to be handled are still better taken into consideration than hitherto done and by means of which bands can be produced, having edges with an improved smoothness and which allows a preciser maintaining of the width of the band along the complete band produced.

A further object is to provide a band cutting machine, in which first feeler means comprise a bracket intended to embrace a not yet spread out section of the textile article drawn off the supply, which bracket is supported on the turntable for a limited rotation thereupon, and comprises a feeler member operative to measure the angular position of the bracket relative to the turntable and of which the measured values are fed to a control apparatus operative to control the relationship between the peripheral speed of the feeding cylinders and the rotational speed of the turntable such that upon an exceeding of a predetermined limit value of the angular position the relationship is adjusted to correct the condition of exceeding the limit value of the angular position, which cutting means include axially arrested cutting tools, which at least one second feeler means is located between the cutting means and the feeding cylinder having the smallest distance therefrom, which second feeler means is further operative to generate an output signal led to a means for adjusting the stroke of the jacket members of at least one of the article feeding cylinders.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
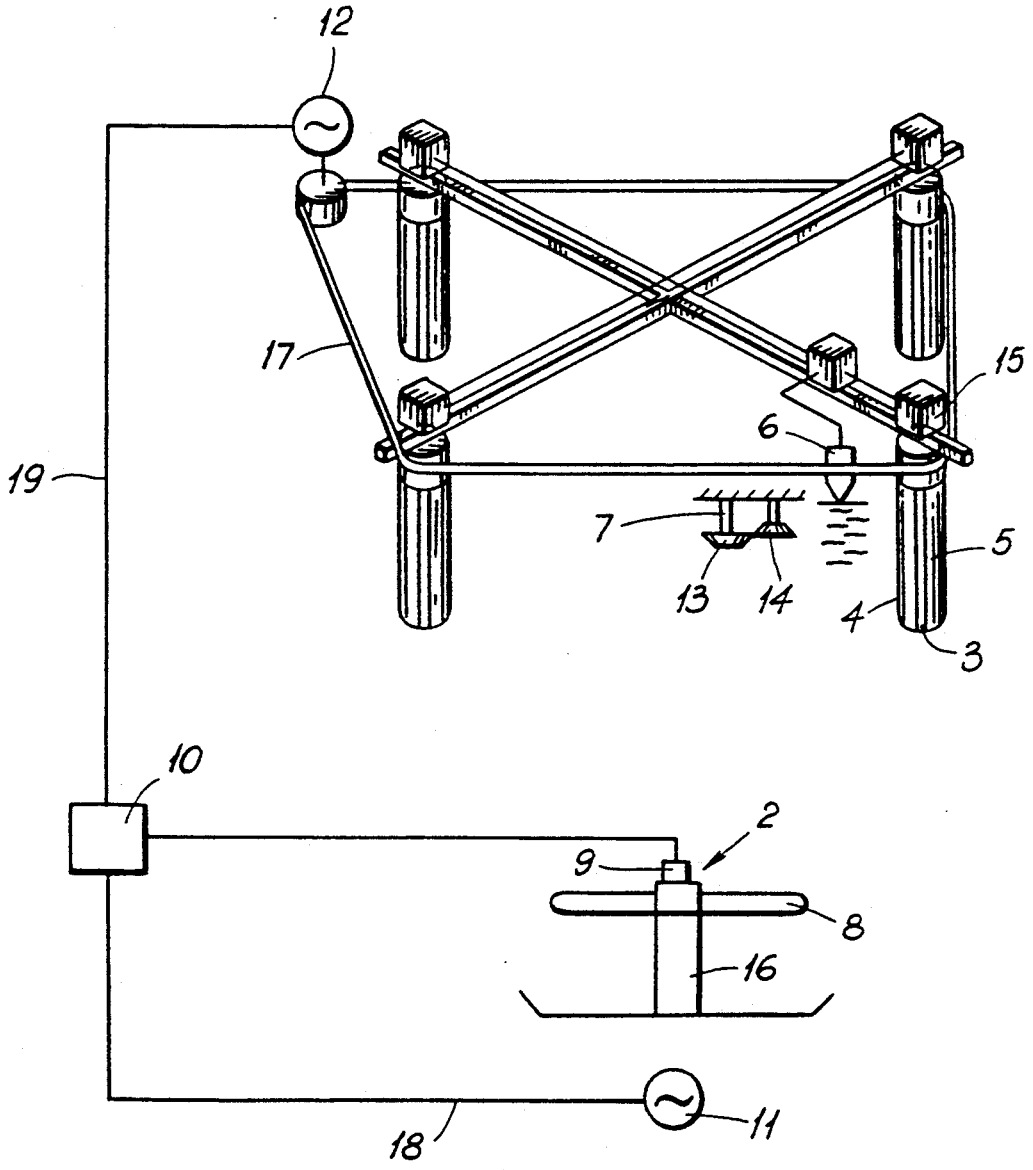
FIG. 1 illustrates schematically an embodiment of the invention.

The general design of the band cutting machine to which reference is made in this specification is identical to the structure disclosed in the U.S. Pat. No. 4,592,260, which is explained therein in detail with the exception obviously of those elements forming the basis of the present invention such that a further detailed description of the structure, design and operation of this band cutting machine is deleted. Accordingly, reference is made specifically to mentioned U.S. Pat. No. 4,592,260. Only those structure elements are described here below which are necessary for the understanding of the present invention.

The band cutting machine includes a turntable 1. The tubular textile article which is to be cut into one or several bands is disposed on this turntable 1 in a supply configuration, i.e. in a rolled or folded position. The drive of the turntable 1 is made by a motor 11. A bracket 8 is supported in a support 16 which is rigidly mounted to the turntable 1. This bracket 8 is rotatable within a limited extent in a plane extending perpendicularly to the plane of the drawing sheet. A feeler member 9 is present on or in, respectively, the support 16. This feeler member is operative to feel the rotational position of the bracket 8 relative to the turntable 1. This feeler member 9 shall operate specifically then, if the rotational position of the bracket 8 relative to the turntable 1 exceeds a predetermined value, i.e. a predetermined angle. Such feeler members are generally known and are available in a multitude of designs. The feeler member can be an electromechanically operating member, can operate purely electrically or also optically.

The measured value as scanned by the feeler 9 of the first feeler 2 is led to a control apparatus 10.

The feeding cylinders 3 are driven by a drive motor 12 via a belt drive 17.

The control apparatus 10 is connected via the control line 18 to the motor 11 of the turntable 1 and via the control line 19 to the drive motor 12 of the feeding cylinders 3.

As is generally known, the turntable 1 rotates in operation in the same sense of rotation as the feeding cylinders 3. These feeding cylinders 3 should rotate basically specifically with reference to their peripheral speed synchronous with the turntable 1, a condition which, however, due to the slip between the textile articles and the feeding cylinders which occurs due to above mentioned reasons, is not always achievable. Such as now disclosed in mentioned publication, the textile article resting on the turntable 1 is threaded through the bracket 8 and spread around the feeding cylinders 3. If now the rotational speed of the turntable 1 does not correspond to the rotational speed of the textile article spread around the feeding cylinders 3, the textile article will begin to twist such that the bracket 8 rotates faster or slower than the turntable 1. This leads obviously to a change of the angle of the bracket 8 relative to the turntable 1, which change is felt by the feeler member 9, which generates corresponding control signals fed on the first feeler means 2 to the control apparatus 10 which controls the peripheral speed of the feeding cylinders 3 relative to the rotational speed of the turntable 1, such that the twist in the article is eliminated. In this example the speed of the motor 12 of the feeding cylinders 3 is changed to achieve this task.

In order to control the cut width of the band or bands, respectively, the band cutting machine includes at least one second feeler means 6, which feels the position of the upper edge of the textile material or article, respectively, to be cut. This feeler means 6 is also of a kind which is generally available in a large variety of designs. Important is here only, that the output signal of the feeler means 6 is led to an adjusting apparatus 15. This adjusting apparatus 15 controls the stroke of the jacket members 4, 5. The controlling of the movement of these jacket members 4, 5 is the same as that of the above mentioned previous disclosure. The controlling of the stroke can also proceed in accordance with the particulars of mentioned disclosure, whereby here obviously the adjusting mechanism or apparatus, respectively, 15 can consist of a stepping motor or another drive commonly available on the market. According to one embodiment of the invention it is possible to adjust the strokes of all jacket members 4, 5 of all feeding cylinders 3 or alternatively, it is possible to control the strokes of the jacket members of one feeding cylinder 3 only. A further possibility is also to adjust dependent from the position of the upper edge as scanned by the feeler means 6 only the jacket members 4, 5 of a certain number of the feeding cylinders 3. A further arrangement could be to have a feeler means 6 arranged between two feeding cylinders 3, which feeler means 6 can control the jacket members of the preceding or following feeding cylinder 3 as seen in the direction of movement of the article. By means of the scanning of the article at the location between the final feeding cylinder 3 and the cutting members 13, 14 seen in direction of movement of the edge of the article an extremely precise controlling of the cut width of the band is achievable, because usually also at this location a possible slipping of the textile material spread around and by feeding cylinders 3 is likely to occur.

By means of a controlling of the circumferential speed or peripheral speed, respectively, of the feeding cylinders 3 relative to the rotational speed of the turntable 1 including the feeling and corresponding adjusting of the stroke of the jacket members 4, 5 of the feeding cylinders 3, an extremely precisely cut width of the band can be reached.

Figure 2:
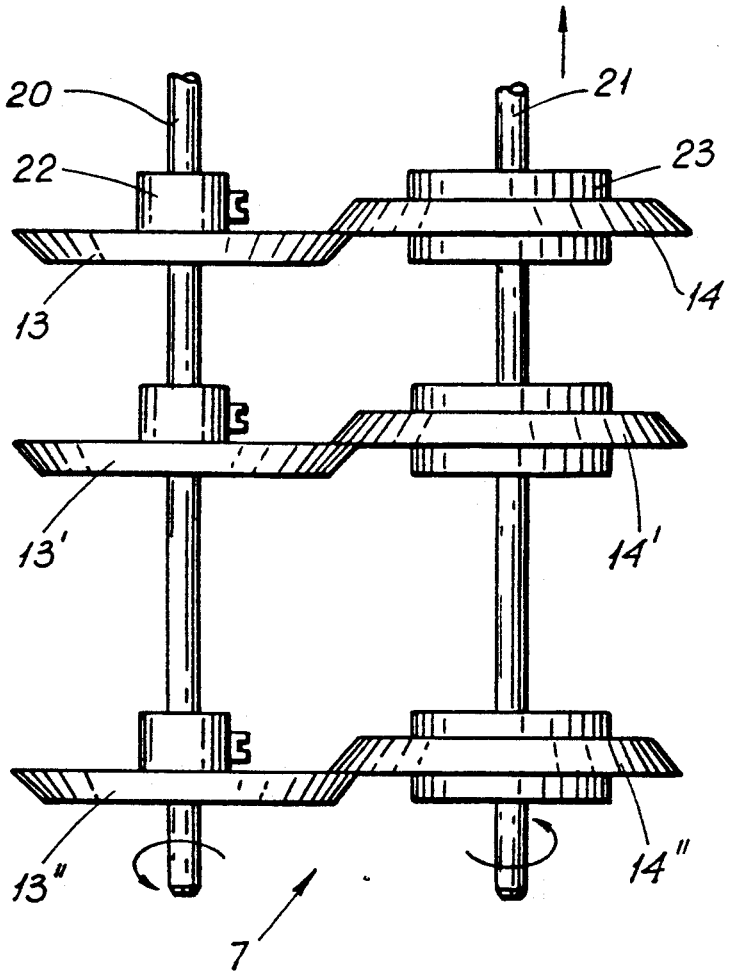
FIG. 2 illustrates schematically an arrangement of circular cutting knives.

FIG. 2 illustrates an embodiment of the cutting apparatus 7, which allows a specifically easy adjusting for a selecting of various widths of the bands being cut. The cutting apparatus 7 includes two oppositely driven cutter shafts 20, 21, which are driven according to a commonly known fashion. Three cutters 13, 13', 13'' e.g. are mounted on one of the two cutter shafts, according to the illustration on cutter shaft 20. Every cutter 13, 13', 13'' includes an arresting device 22, by means of which the respective cutters can be locked to the shaft 20 at any desired position along the shaft such that they are axially and rotationally locked on the shaft. The illustrated example shows to this end a simple hub having a clamping screw. The other cutter shaft is identified by the reference numeral 21, which cutter shaft 21 carries the counter-knives 14, 14', 14'', forming cutter knife pairs with their respective counterparts on the first named cutter shaft 20. In contrast now to known designs, according to which these cutters 14, 14', 14'' are urged by means of e.g. springs against the cutters 13, 13', 13'', these counter-cutters 14, 14', 14'' are arranged on the cutter shaft 21 only in a rotationally arrested manner and are freely movable in axial direction of the shaft. To this end, a tongue and groove structure may be provided on the cutters and the shaft, respectively. Accordingly, the cutters 14, 14', 14'' rest on the cutters 13, 13', 13'' only due to their own deadweight; it has been recognized that surprisingly the force of contact of the upper cutters resting on the lower cutters is sufficient for arriving at a precise cut of the textile material. In order to safely obtain a sufficient resting force specifically in case of higher rotational speeds of the cutter shafts 20, 21 the illustrated embodiment shows cutters 14, 14', 14'' which include somewhat oversized hubs 23, which hubs 23 provide for the necessary weight for achieving an impeccable cut.

Figure 3:
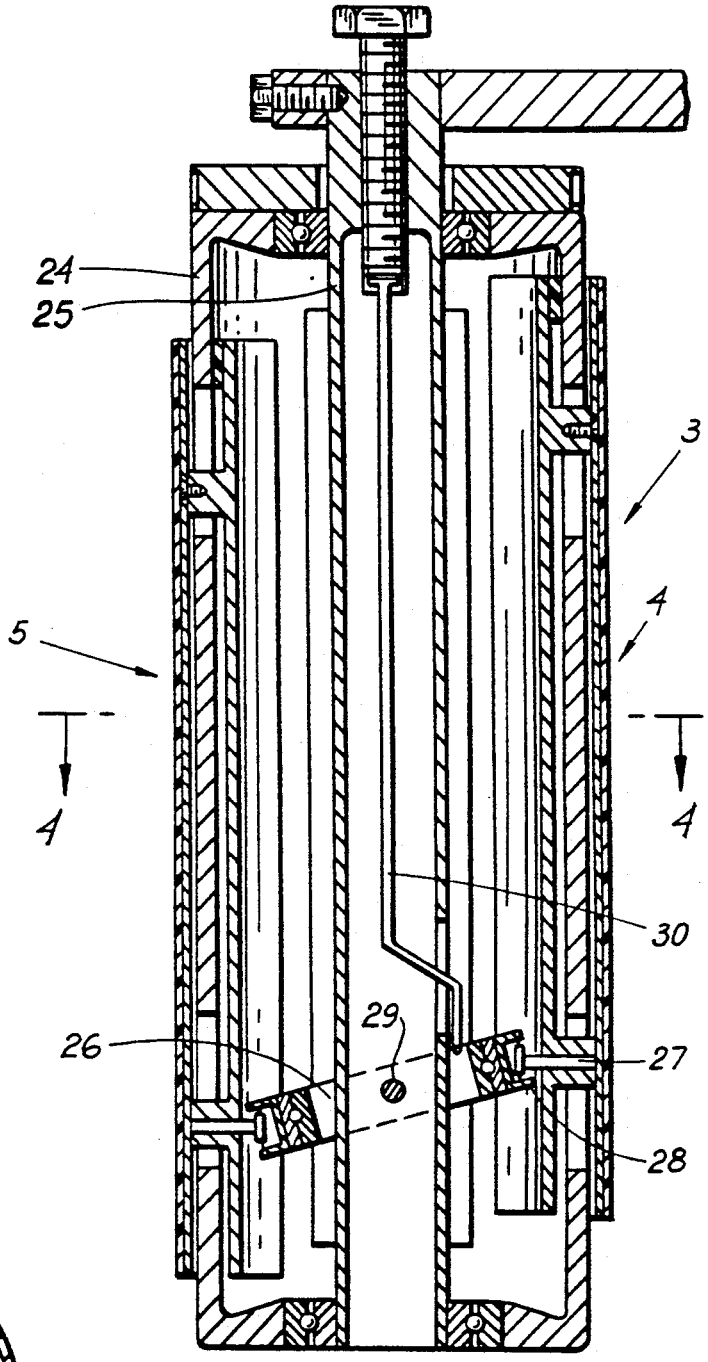
PRIOR ART FIG. 3
FIG. 3, illustrates the prior art feeding cylinder.
Figure 4:
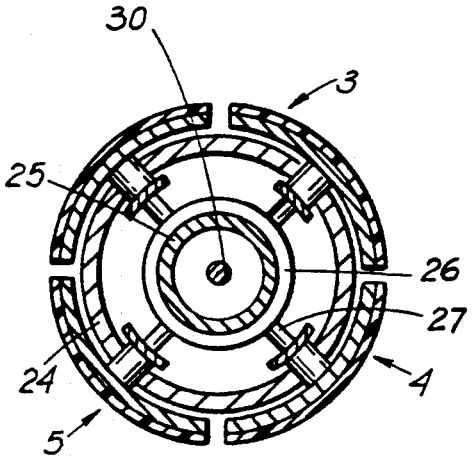
PRIOR ART FIG. 4
FIG. 4 is a view of a section taken along line IV—IV.

FIGS. 3 and 4 illustrate prior art feeding cylinder 3 as disclosed by U.S. Pat. No. 4,592,260. As shown in the prior art, jacket members 4 and 5 are axially oscillated by rotating the hollow cylinder 24 about stationary hollow shaft 25. Inclined annular bearing member 26 is stationary while guided pin members 27, of jackets 4 and 5, rotate in outer race 28 around hollow shaft 25. Due to the inclination of annular bearing member 26, guide pin members 27 reciprocate in the longitudinal direction relative to hollow shaft 25. As a result, jackets 4 and 5 follow a sinus-wave shaped path during rotational movement around hollow shaft 25.

To vary the stroke of jackets 4 and 5, annular bearing member 26 is pivoted about pin 29 by control rod 30.

While there is shown and described a present preferred embodiment of the invention, it is to be distinctly understood that the invention is not limited thereto, but may be otherwise variously embodied and practiced within the scope of the following claims.

We claim:

1. A band cutting machine comprising:

a motor driven turntable to support a supply of a tubular textile article to be cut;

a bracket, supported on said turntable, through which said tubular textile article passes before being cut, said bracket being mounted for a limited horizontal rotation relative to said turntable;

a first feeler means, adjacent to said turntable and said bracket, to scan the angular deviation of a longitudinal axis of said bracket from a given axis of said turntable, said first feeler providing a first signal indicative of said angular deviation;

a plurality of motor driven rotating article feeding cylinders which each have a plurality of axially oscillating jacket members having a stroke that is adjustable by a means for adjusting the stroke of said jacket members of at least one of said article feeding cylinders;

cutting means having rotating cutting members for cutting said tubular textile article into at least one band, said cutting means including two oppositely rotating cutter shafts supporting pairs of interacting first and second circular cutting knives, each of the first circular cutting knives on one of said cutter shafts having a locking means, by means of which each first circular cutting knife may be locked to one of said cutter shafts at a selected axial position in an axially and rotationally locked condition, the second circular cutting knives on an other cutter shaft are axially movable along said other cutter shaft, but are rotationally locked in position on said other cutter shaft by a tongue and groove means on said second circular cutting knives and said other cutter shaft, wherein each of said second circular cutting knives is weighted to rest on a corresponding first circular cutting knife to position said second circular cutting knife on said other cutter shaft;

at least one second feeler means, being positioned between said cutting means and one of said article feeding cylinders, to scan the position of a section of the edge of the tubular textile article when said textile article is engaged with said article feeding cylinders and provide a second signal to be fed to said means for adjusting the stroke of said jacket members of at least one of said article feeding cylinders; and a control apparatus connected to said motor driven article feeding cylinders, said turntable, and said first feeler so that in operation the rotational speed of said turntable and said article feeding cylinders can be adjusted according to the first signal input from said first feeler.

* * * * *